United States Patent [19]

Sylvia et al.

[11] Patent Number: 5,020,400

[45] Date of Patent: Jun. 4, 1991

[54] WING FOLDING TOOL

[75] Inventors: Robert E. Sylvia, Woodford; Thomas E. Dillard, Fredericksburg, both of Va.

[73] Assignee: The United States of America as represented by the Secretary of the Navy, Washington, D.C.

[21] Appl. No.: 456,884

[22] Filed: Dec. 26, 1989

[51] Int. Cl.[5] ..... B25B 33/00

[52] U.S. Cl. ..... 81/484; 81/488

[58] Field of Search ..... 81/488, 484

[56] References Cited

U.S. PATENT DOCUMENTS 3,036,482 5/1962 Kenworthy et al. ..... 173/90

4,470,440 9/1984 Thor ..... 173/90

4,624,323 11/1986 Burrola ..... 173/90

4,641,412 2/1987 Olger ..... 29/270

*Primary Examiner*—Roscoe V. Parker

*Attorney, Agent, or Firm*—John D. Lewis; Kenneth E. Walden

[57] ABSTRACT

An improved tool for folding and unfolding spring-loaded missile wings is disclosed. The tool comprises an angled aluminum shaft with an unlocking stud sized to engage the wing deployment mechanism inside the wing. After a U-bracket has been attached to the wing's mounting bar, the tool is inserted into the U-bracket until the unlocking stud in positioned over the hole in the wing leading to the wing deployment mechanism. Pushing the unlocking stud through the hole forces the wing deployment mechanism to unlock, thus allowing the wing to be folded. The tool is also designed to assist in the wing spreading operation.

5 Claims, 3 Drawing Sheets

WING FOLDING TOOL

BACKGROUND OF THE INVENTION

This invention relates generally to folding wings for missiles and particularly to an improved tool for folding wings on the PENGUIN Airborne Guided Missile.

The PENGUIN Missile was developed for use on the Seahawk Helicopter of the LAMPS III program. Folded wings are installed on the missile after the missile is attached to the helicopter. The wings must be folded due to the space limitations under the helicopter.

The missile's wings contain a wing deployment mechanism which locks the wings in their upright position by using powerful torsion springs. The wing deployment mechanism must be unlocked in order to fold the wings. The wing folding process must be done quickly to provide an adequate response time while in combat. Wing folding requires the continuous application of approximately sixty pounds of lateral force to the wing's outer edge to lock the wing into its folded position.

The previous method for folding the wings involved the use of an unlocking bolt. The unlocking bolt was screwed into a threaded hole in the wing approximately ¾ of an inch until the bolt forced the wing hinge open. The outer edge of the wing was then grabbed by personnel and pulled down until the wing locked into its folded position. The unlocking bolt then had to be unscrewed from the threaded hole in the wing before the wing could be attached to the missile. This procedure posed many problems The screwing of the unlocking bolt was slow and wasted valuable time. Frequent insertion of the bolt into the threaded hole wore down the threads in the hole, thus requiring frequent replacement of the threaded insert. If the wing slipped from the person's grasp during the folding process, the force of the wing hinge on the unlocking bolt could force the unlocking bolt out of the threaded hole, causing the threads to rip and possibly injuring anyone standing in front of the unlocking bolt. Finally, since no means of attaching the unlocking bolt to the mounting bar was available, the tool was frequently lost or misplaced.

The unlocking bolt also could not be used to perform the wing spreading (unfolding) operation. A lanyard release assembly, located on the trailing edge of the wing, locked the wing in its folded position. To unfold the wing, a release link had to be removed from the lanyard release assembly. This was done by attaching a piece of string to the release link and pulling upward until the release link popped off the lanyard release assembly.

SUMMARY OF THE INVENTION

The new tool eliminates the problems posed by the unlocking bolt. The tool comprises an angled shaft with a knurled handle on the aft end. The front end of the tool is shaped so that it can assist in the wing spreading operation. An unlocking stud, located near the front end, protrudes perpendicularly from the shaft. The tool is attached to the wing mounting bar by a metal cable. A U-bracket is also mounted to the wing mounting bar directly underneath the threaded hole on the wing.

The wing is easily folded by placing the end of the tool into the U-bracket on the mounting bar until the unlocking stud is positioned over the threaded hole. The unlocking stud is then pushed through the threaded hole by gripping the handle and pushing the tool toward the wing. When the unlocking stud unlocks the wing deployment mechanism, personnel can fold the wing by pulling on the outer edge of the wing. The unlocking stud is removed from the threaded hole simply by pulling back on the handle.

The new tool also provides a feature for removing the release link from the lanyard release assembly without having to use string.

OBJECTS OF THE INVENTION

An object of the invention is to provide a quicker means of folding and unfolding a wing on a PENGUIN missile.

Another object of the invention is to accomplish the wing folding operation without damaging the threaded hole on the wing or injuring personnel.

Another object of the invention is to reduce the chance of losing the tool.

DETAILED DESCRIPTION OF THE INVENTION

Figure 1:
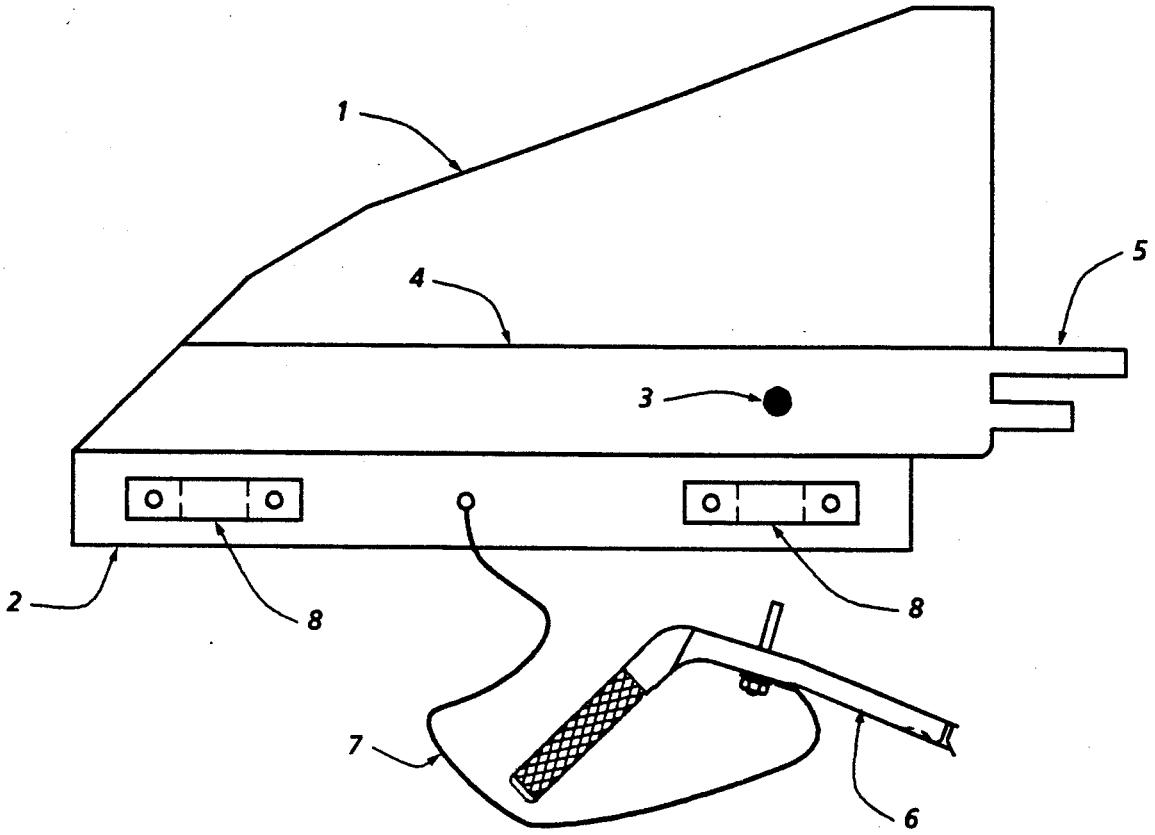
FIG. 1 is a side view of the wing mounted onto the mounting bar which the wing folding tool and the U-bracket are attached.

FIG. 1 is a side view of the wing i mounted on the mounting bar 2. A threaded hole 3 on the wing provides access to the wing deployment mechanism 22 located within the wing 1. Mechanism 22, not shown in FIG. 1 may be viewed in detail in FIG. 4. The wing folds along a line 4 above the threaded hole 3. A U-bracket 8 is bolted onto the wing mounting bar 2 directly below the threaded hole 3. A second U-bracket can be added to the mounting bar to accommodate different wing designs.

Figure 2:
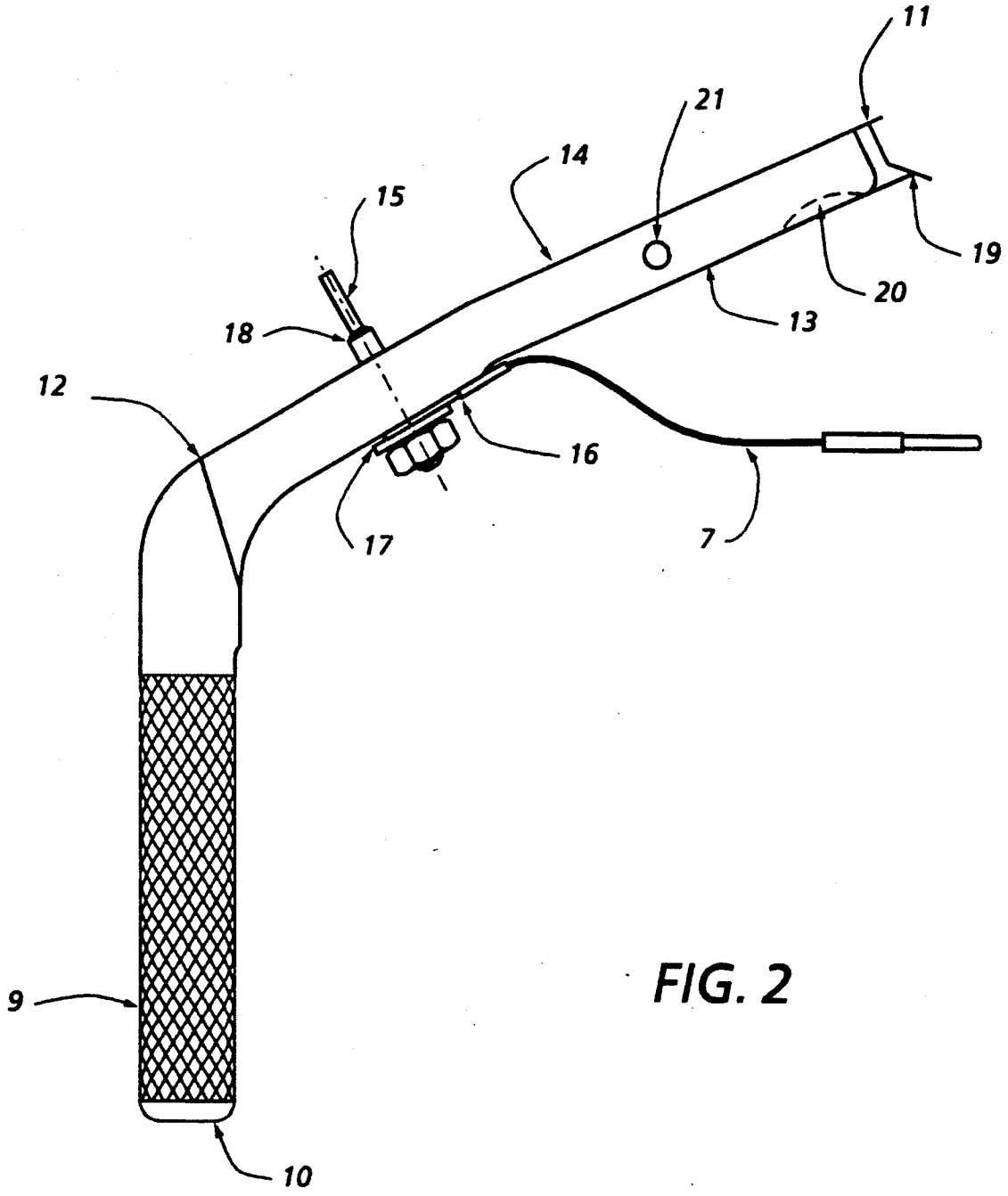
FIG. 2 is a side view of the wing folding tool shown in FIG. 1.

FIG. 2 shows a side view of the wing folding tool 6. The wing folding tool 6 comprises an angled aluminum shaft with a knurled handle 9 on the aft end 10. A portion of the shaft from the front end 11 to the middle 12 of the shaft is machined so that the shaft has a rectangular cross-section. The remainder of the shaft, including the handle 9, is cylindrical. A hole is drilled midway of the rectangular section from the bottom face 13 to the top face 14. An unlocking stud 15 is then screwed into the hole and secured with a nut 18. The unlocking stud 15 is a stainless steel bolt with the lower threads removed.

A cable 7 is attached to the tool by slipping the cable ring 16 over the unlocking stud 15 before the unlocking stud 15 is inserted into the hole. Cable 7 is simply an attachment lanyard that attaches tool 6 to wing fold bar 2 so that the tool and bar do not become separated while in storage or non-use. A washer 17 is placed between the cable ring 16 and the top of the unlocking stud 15. The other end of the cable 7 is secured to the wing mounting bar 2. When the wing folding tool 6 is not in use, it can be placed in the U-bracket 8 and secured by inserting a safety pin through a small hole 21 drilled through the tool's rectangular section.

Figure 3:
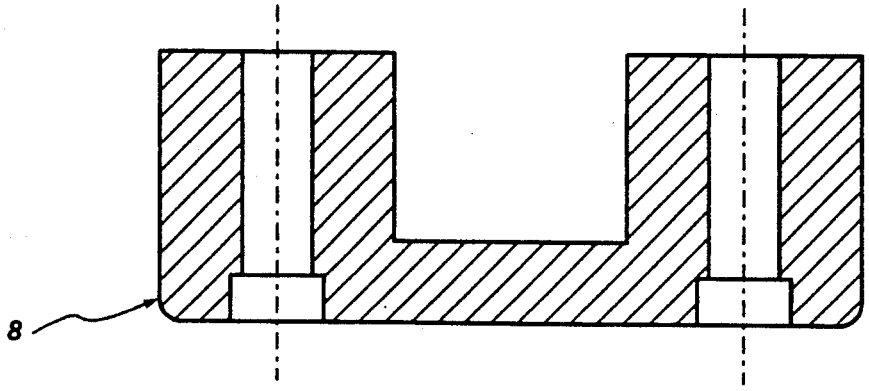
FIG. 3 is a top view of the U-bracket which is bolted to the mounting bar in FIG. and used in conjunction with the wing folding tool in FIG. 2.

The wing folding tool 6 requires the use of a U-bracket 8 which is bolted to the wing mounting bar 2 directly underneath the threaded hole 3 on the wing. The U-bracket 8, shown in FIG. 3, is also made of aluminum and is sized so that the rectangular section of the tool can easily fit through the bracket.

Figure 4:
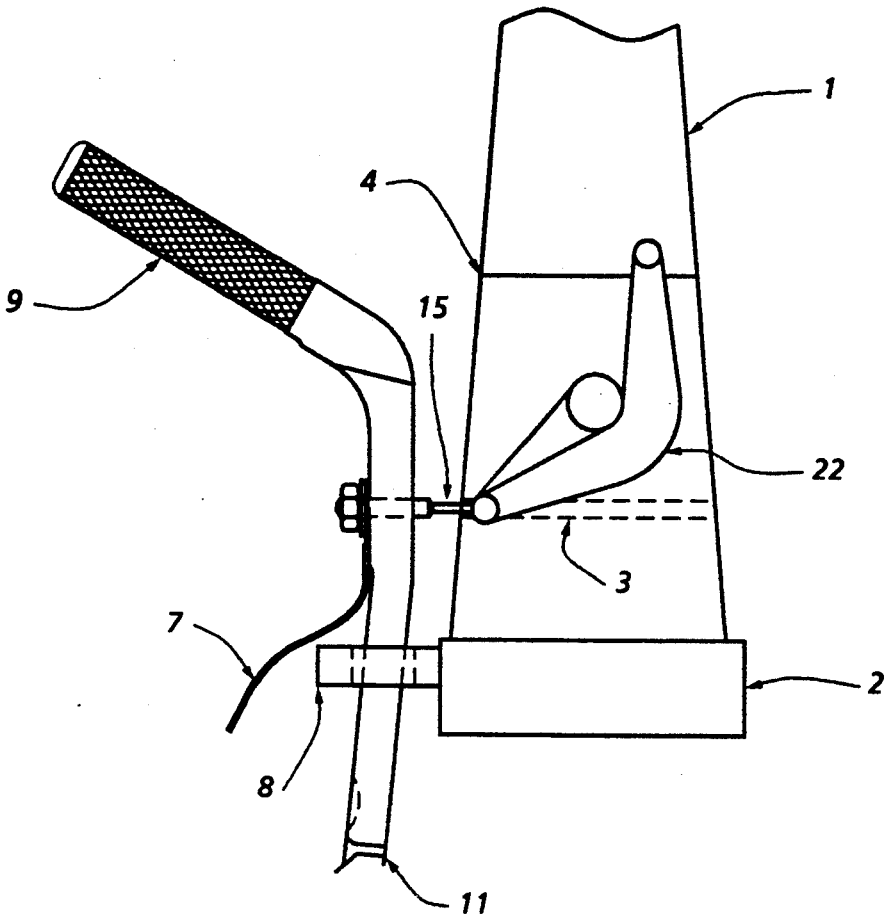
FIG. 4 is an illustration of how the tool in FIG. 2 unlocks the wing deployment mechanism located within the wing of FIG. 1.

The wing folding operation is illustrated in FIG. 4. The front end 11 of the tool is slid into the U-bracket 8 so that the unlocking stud 15 is pointing toward the wing 1. When the unlocking stud 15 is aligned over the threaded hole 3, the unlocking stud 15 is pushed into the hole 3 by pushing the tool toward the wing 1 while gripping the handle 9. As the unlocking stud 15 is pushed into the threaded hole 3, it unlocks the wing deployment mechanism 22. When the unlocking stud 15 can no longer be pushed into the threaded hole 3, the wing 1 can be folded by gripping the wing's outer edge and pulling it until the wing 1 locks into its folded position. The tool can then be removed from the threaded hole 3 and stored in the U-bracket 8.

Figure 5:
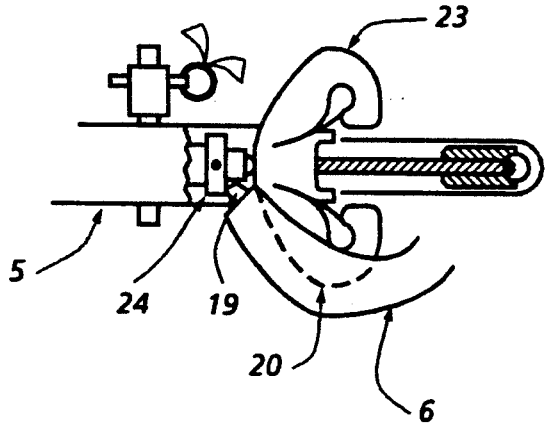
FIG. 5 is a side view of the release link assembly which is located on the trailing edge of the wing in FIG. I.

The tool can also be used to remove the lanyard release link 23 and unfold the wing. Referring to FIG. 5, the lanyard release link 23, located on the trailing edge 5 of the wing, locks the wing into its folded position. The release link 23 is removed by inserting the pointed edge 19 of the front end of tool 6 between the lanyard release assembly 24 and the bottom of the release link 23. The groove 20 on the front bottom end of the tool is shaped to receive the bottom end of the release link 23. The lanyard release assembly 24 is pushed forward by the tool until it stops. The release link 23 is then pushed upward by the tool until the release link 23 pops off the lanyard release assembly 24. Removal of the release link 23 allows the wing to unfold.

The lanyard release assembly 24 is of a conventional type known to those skilled in the ordnance art. Lanyard release link 23 is attached by a lanyard (not shown) to the aircraft whereby dropping the missile pulls link 23 free, allowing the lanyard release assembly 24 to release and unlock the missile wings. Pin 25 prevents this movement and is a safety feature for ground handling. Pin 25 is removed before flight.

The wing folding tool solves all of the problems posed by the unlocking bolt. The unlocking stud will not damage the threaded hole on the wing because it doesn't engage the threads in the hole at any time during the folding process. The tool is also quick to use since it does not have to be screwed into and out of the threaded hole. The tool is easily accessible since it is secured to the wing mounting bar.

What is claimed is:

1. A tool for unlocking a wing deployment mechanism inside a missile's foldable wings which are mounted on a mounting bar and for removing a release link from the wing's lanyard release assembly, comprising:

an angled shaft having a front and aft end and a top and bottom face;

a handle composing said aft end of said angled shaft;

a bolt with its lower threads removed, said bolt protruding through said bottom face to said top face and secured to said angled shaft, said bolt sized to engage the wing deployment mechanism on the wing;

a U-shaped bracket bolted onto the mounting bar directly beneath the wing deployment mechanism.

2. The tool of claim 1 wherein said front end of said angled shaft is pointed and said front bottom face is grooved to assist in removing the release link from the lanyard release assembly.

3. The tool of claim 1 wherein a cable attaches said tool to the mounting bar.

4. The tool of claim 1 wherein said handle is knurled.

5. The tool of claim 1 wherein said angled shaft is made of aluminum.

* * * * *